US005133109A

United States Patent [19]

Mariani

[11] Patent Number: 5,133,109

[45] Date of Patent: Jul. 28, 1992

[54] APPARATUS FOR THE ADJUSTABLE ATTACHMENT OF A WARDROBE DOOR TO A DOOR-SUPPORTING ARM

[75] Inventor: Roberto Mariani, Milan, Italy

[73] Assignee: O.M.M. di Enrico e Ing. Roberto Natale Mariani s.n.c., Milan, Italy

[21] Appl. No.: 615,286

[22] Filed: Nov. 19, 1990

[30] Foreign Application Priority Data

Nov. 21, 1989 [IT] Italy ..... 22466 A/89

[51] Int. Cl.[5] ..... E05D 7/04

[52] U.S. Cl. ..... 16/238; 16/249; 16/DIG. 43

[58] Field of Search ..... 16/238, 243, 245, 249, 16/DIG. 43

[56] References Cited

U.S. PATENT DOCUMENTS

| | | | |
|---|---|---|---|
| 2,839,778 | 6/1958 | Hutchinson et al. . | |
| 4,045,841 | 9/1977 | Rock et al. | 16/238 |
| 4,142,271 | 3/1979 | Busse | 16/238 |
| 4,817,241 | 4/1989 | Koch et al. | 16/238 |

FOREIGN PATENT DOCUMENTS

| | | | |
|---|---|---|---|
| 2342113 | 2/1975 | Fed. Rep. of Germany | 16/238 |
| 3543121 | 6/1987 | Fed. Rep. of Germany | 16/262 |
| 2088762 | 1/1972 | France . | |
| 2241680 | 3/1975 | France . | |
| 2348347 | 11/1977 | France . | |
| 2399523 | 3/1979 | France . | |
| 472565 | 6/1969 | Switzerland . | |

*Primary Examiner*—Robert L. Spruill
*Assistant Examiner*—Carmine Cuda
*Attorney, Agent, or Firm*—Nixon & Vanderhye

[57] ABSTRACT

An apparatus for the adjustable attachment of a wardrobe for (42) to a door supporting arm (SA) comprises a first part (1) for attachment to the supporting arm (SA); a second part (7); and, a third part (8) which is mounted to the door (42). Threaded rotatable tangs (27) are provided to adjust the position of the first part (1) with respect to the second part (7) in a first direction. Threaded rotatable tangs (29) are also provided to adjust the position of the second part (7) with respect to the third part (8) in a second direction, the second direction being perpendicular to the first direction.

13 Claims, 4 Drawing Sheets

APPARATUS FOR THE ADJUSTABLE ATTACHMENT OF A WARDROBE DOOR TO A DOOR-SUPPORTING ARM

BACKGROUND OF THE INVENTION

I. Field of the Invention

This invention relates to means for the adjustable attachment of a wardrobe to a supporting arm.

II. Prior Art and Other Considerations

In wardrobes with a movable door there is the problem of accurately adjusting the position of the movable door with respect to the fixed body. When the connection between the door and the body is provided by means of conventional hinges the latter have for a long time been provided with suitable means of adjustment whereby the position of the door can be adjusted in both the horizontal and vertical position.

There are however wardrobes in which the door is attached to the fixed body by means of supporting arms. An example of such wardrobes is described and illustrated in Italian patent application no. 20012 A/88 of Mar. 29, 1988.

In this type of wardrobe the problem of adjusting the position of the door arises in a different way and cannot be solved in similar manner.

The object of this invention is to provide an adjustable assembly for attaching a door-supporting arm whereby the door can be attached to the supporting arm in a manner which is adjustable in a vertical and horizontal direction.

Another object is to provide an assembly of this type which are of particularly simple construction.

SUMMARY

In accordance with the invention this object is accomplished by an assembly for the adjustable attachment of a wardrobe door to a supporting arm characterised in that it comprises a first part designed for attachment to the supporting arm, a second part and a third part designed to be fixed to the door, first means to adjust the position of the said first part with respect to the second part in a first direction and second means to adjust the position of the said second part with respect to the third part in a second direction perpendicular to the first being provided.

BRIEF DESCRIPTION OF THE DRAWINGS

The characteristics of this invention will be more clearly illustrated by the following detailed description of an embodiment which is illustrated by way of a non-restrictive example in the attached drawing, in which.

DETAILED DESCRIPTION OF THE DRAWINGS

Figure 1:
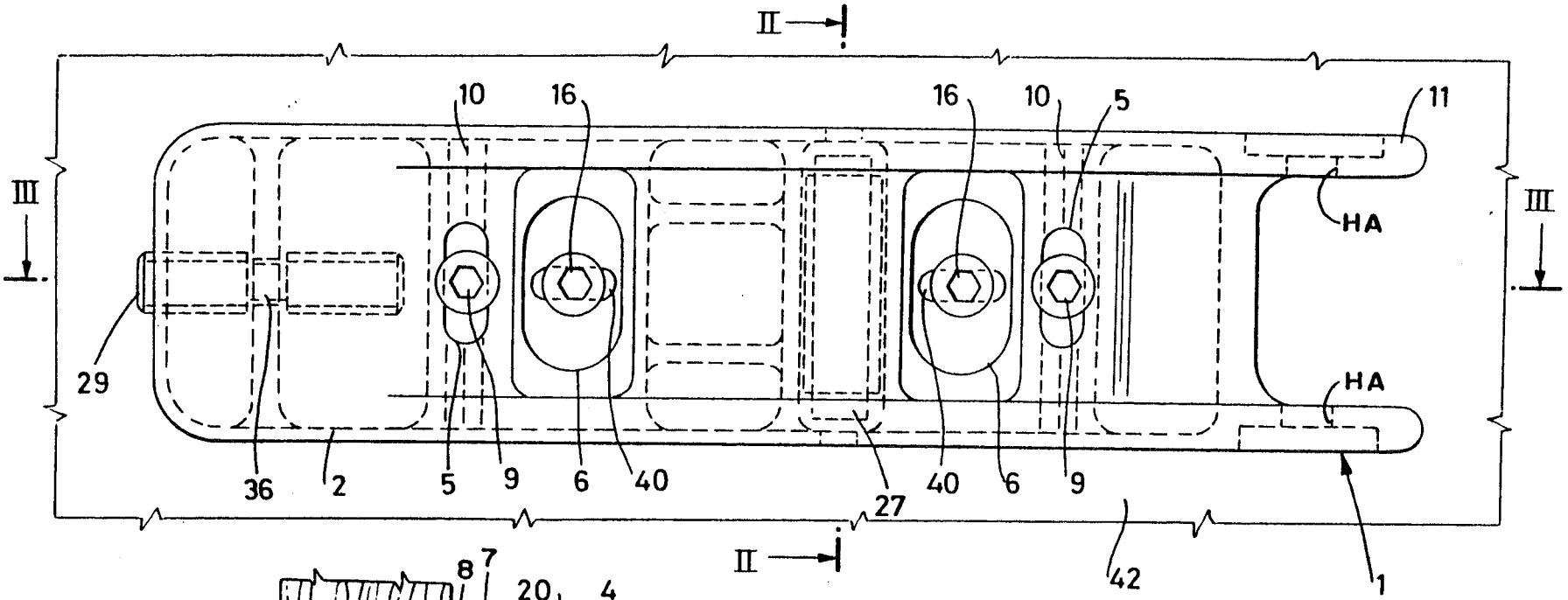
FIG. 1 provides a frontal view of an adjustable assembly for attaching a door-supporting arm according to the invention, FIG. 2 provides a cross-sectional view of the means along the line II—II in FIG. 1, FIG. 3 provides a view of the assembly in the longitudinal cross-section along the line III—III in FIG. 1, FIG. 4 provides a rear view of the first part of the assembly in FIGS. 1-3, FIG. 5 provides a view of the first part in longitudinal cross-section along the line V—V in FIG. 4, FIG. 6 provides a frontal view of the second part of the same assembly, FIG. 7 provides a view of the second part in longitudinal cross-section along the line VII—VII in FIG. 6, FIG. 8 provides a view of the second part in transverse cross-section along the line VIII—VIII in FIG. 7, FIG. 9 provides a frontal view of the third part of the same assembly, FIG. 10 provides a view of the third part in longitudinal cross-section along the line X—X in FIG. 9.
Figure 2:
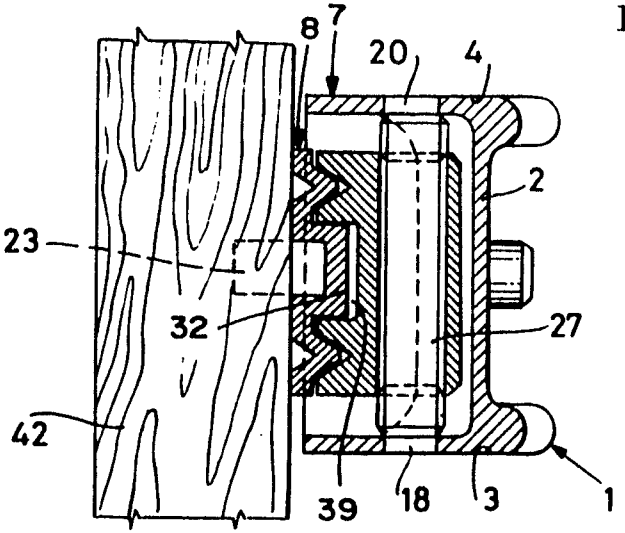
Figure 3:
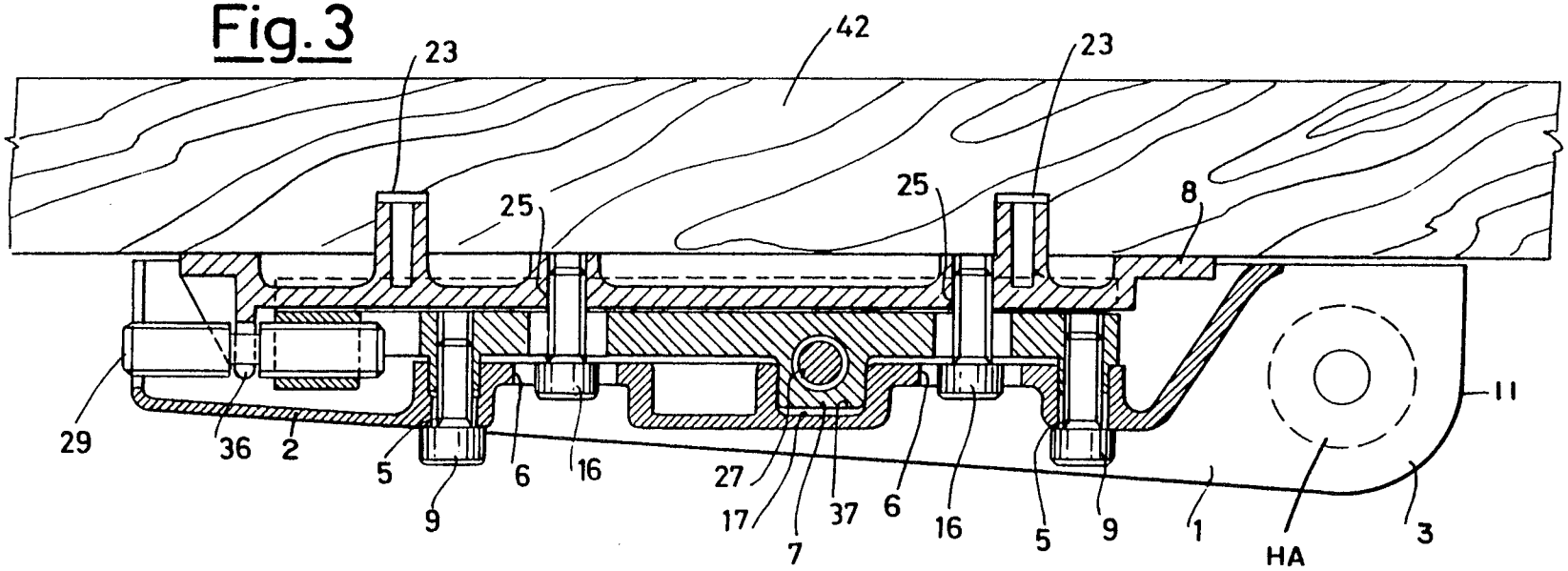

With reference to FIGS. 1, 2, 3, an adjustable assembly for attaching a door-supporting arm comprises first part 1 constructed in the form of a receptacle to provide an inner housing space for a second part 7 and a third part 8. The first part 1 is also referred to as the first member; likewise, the second part 7 and the third part 8 are also referred to as second and third members, respectively.

Figure 4:
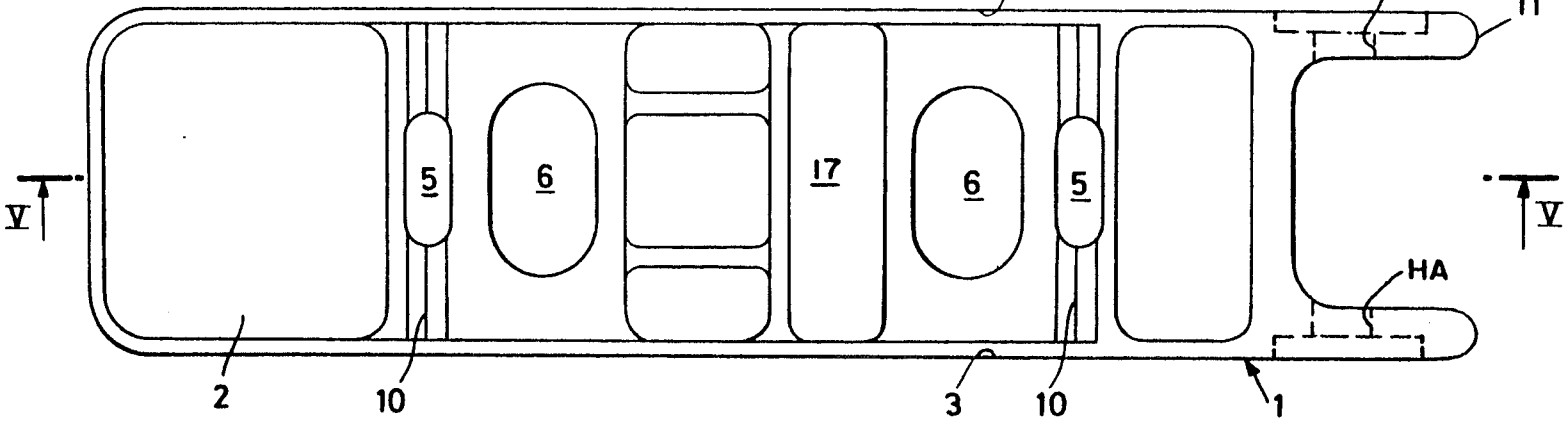
Figure 5:
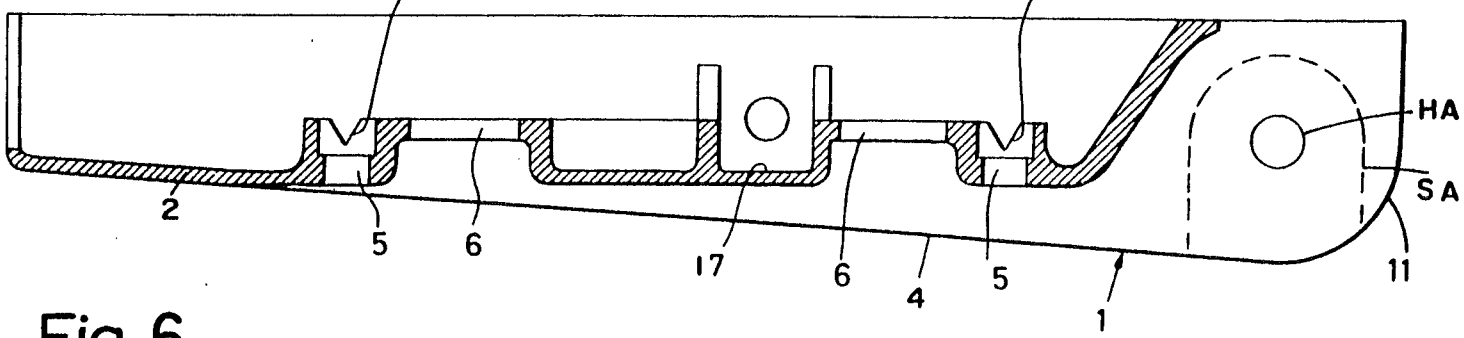

As illustrated in detail in FIGS. 4 and 5, the first part 1 comprises a vertical wall 2 from which extend horizontal walls 3, 4, one of whose ends 11 is constructed in the form of a fork for the attachment of a connecting hinge, not illustrated, to the door supporting arm. Ends 11 of walls 3, 4 have hinge apertures HA formed therein for receiving the unillustrated hinge. The unillustrated hinge connects the first part 1 to the door supporting arm SA (shown by broken lines in FIG. 5). A first pair of vertically elongated openings 5 for the passage of bolts 9 designed to secure first part 1 with respect to second part 7, and a second pair of openings 6, which are vertically elongated and of dimensions greater than those of the first pair of openings 5, designed for the free passage of bolts 16 for fixing second part 7 to third part 8, are provided in vertical wall 2.

The internal surface of vertical wall 2 bears some ribs which form a pair of guide grooves 10 having a V-shaped cross-section corresponding to openings 5 and a further groove 17 with a square cross-section in an intermediate position between openings 6. The above-mentioned grooves 10 are designed to guide second part 7 with respect to first part 1. The two horizontal walls 3, 4 of first part 1 have corresponding openings 18, 20 designed for the passage of a tool for adjusting the vertical position of second part 7 as will be more particularly described below.

Figure 6:
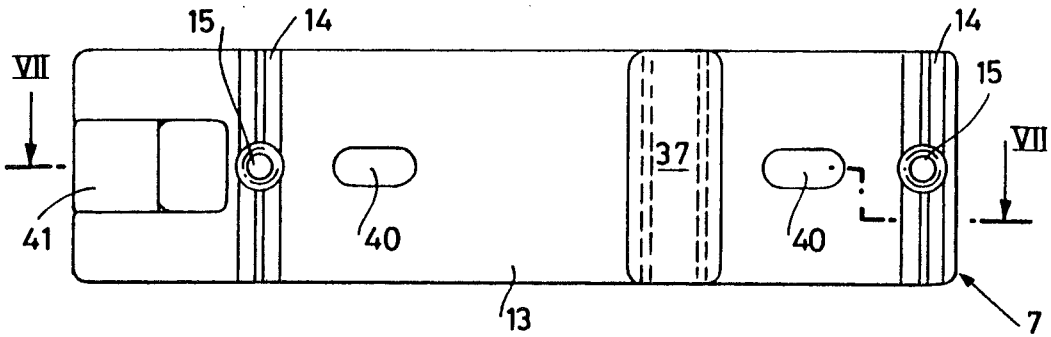
Figure 7:
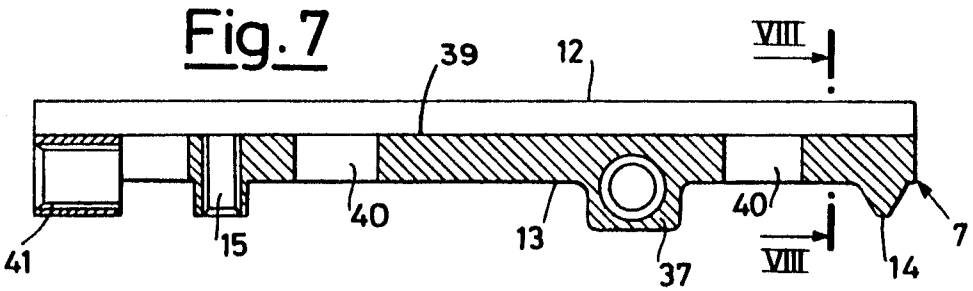
Figure 8:
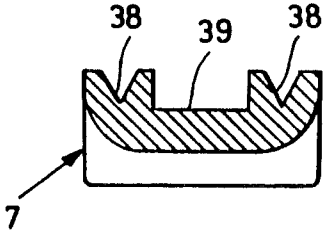
Figure 11:
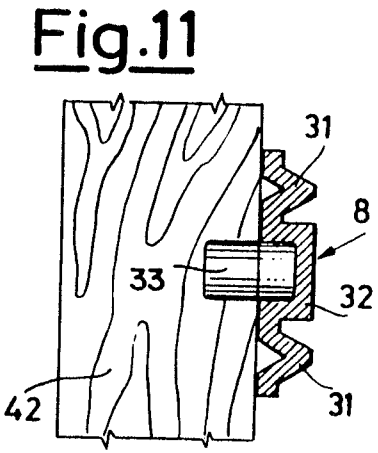
FIG. 11 is a transverse cross-section through the third part along the line XI—XI in FIG. 9, FIG. 12 provides a side view of the same part from the right hand side.
Figure 12:
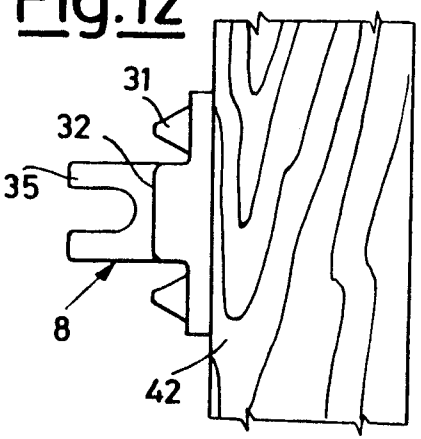
Figure 9:
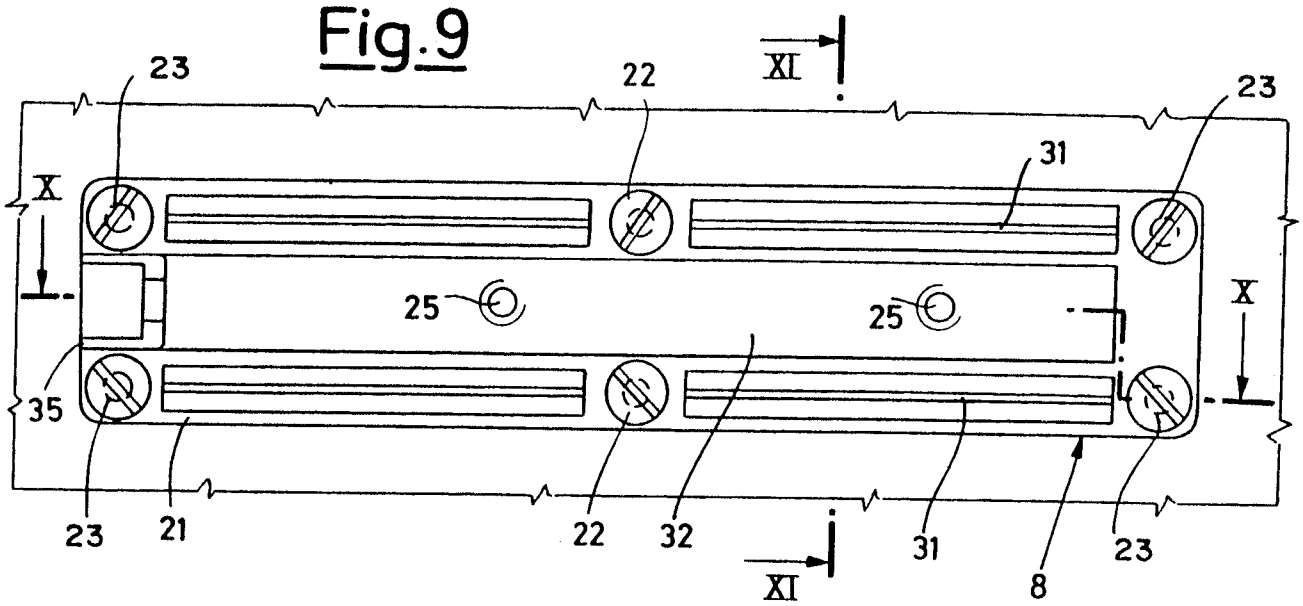
Figure 10:
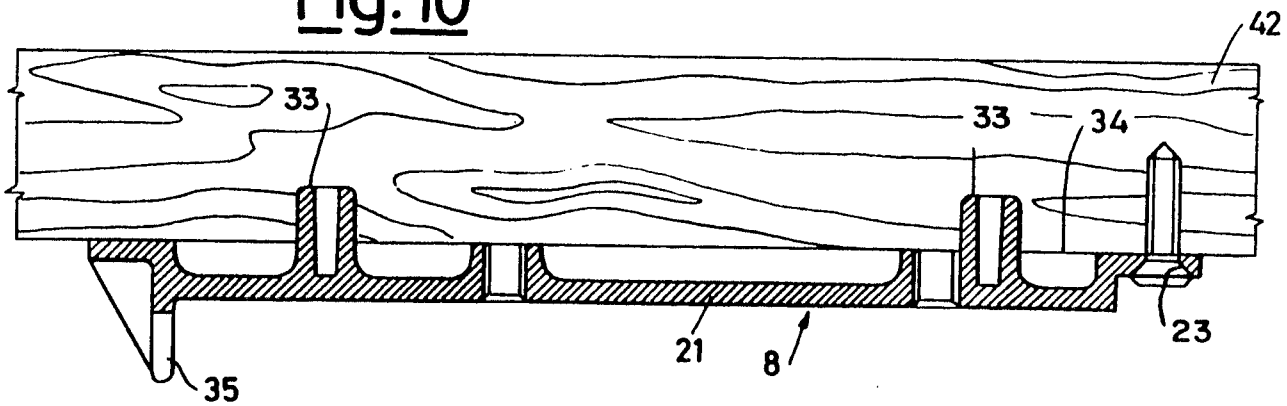

With reference to FIGS. 6, 7 and 8, second part 7 takes the form of a rectangular prism having a first vertical wall 12 and a second vertical wall 13. A pair of projections 14 of triangular cross-section interrupted at the centre by corresponding holes 15 project from vertical wall 13. When mounted the two pairs of projections are inserted into guide grooves 10 of first part 1 and holes 15 are aligned with vertically elongated openings 5 to receive securing bolts 9. A rib 37 of square cross-section which when mounted is inserted in square cross-section groove 17 projects from this wall. Rib 37 of square cross-section is engaged transversely to the longitudinal dimension of part 7 by means of a threaded tang 27 for adjustment of second part 7 with respect to first part 1. Adjustment is provided by acting on threaded tang 27 by means of a suitable tool (for example a hexagonal nut spanner) by passing it through hole 18 or 20 (depending on the selected orientation of tang 27) and engaging one end of threaded tang 27, through the reaction of the other end of this tang against the adjacent wall 3 or 4 of the first part (FIG. 2).

At one end of second part 7 there is provided a central projection 41 which is engaged by a further threaded tang 29 which has the function of ensuring adjustment of the horizontal position of second part 7 with respect to third part 8, as more particularly described above. This threaded tang 29 has a non-threaded central portion 36 of reduced diameter whose objects will be described below. In the space between projections 14 of triangular cross-section and rib 37 of square cross-section there is a pair of horizontally elongated openings 40 positioned to correspond with openings 6 in vertical wall 2 of first part 1.

The second vertical wall 12 of second part 7 has a pair of lateral grooves 38 of V-shaped cross-section which extend the entire length of second part 7 and a central groove 39 of square cross-section between the two, parallel thereto and of similar length.

With reference to FIGS. 9–12 third part 8 is constructed in the form of a rectangular plate of which one side 21 is designed to fit against vertical wall 12 of second part 7 and for this purpose is provided with a pair of longitudinal ribs 31 of triangular cross-section which engage longitudinal grooves 38 of second part 7 (FIG. 8) and a central rib 32 of square cross-section which can be housed in corresponding central groove 39 of the second part. Longitudinal ribs 31 of triangular cross-section are interrupted by through holes 22 which together with similar terminal holes 23 allow third part 8 to be fixed to a wardrobe door 42 by means of second side 34 which is provided with centering tangs 33. Central rib 32 in turn has a pair of holes 25 which can be engaged by bolts 16 for securing third part 8 to second part 7. At one end of central rib 32 there is fork 35 which rises from face 21 and straddles threaded tang 29 at the location of its non-threaded portion 36 (FIG. 3).

The procedure for adjusting the position of the door fixed to third part 8 with respect to the supporting arm to which first part 1 is attached is as follows.

First of all bolts 9 and/or 16 are slackened off to provide a certain amount of play between parts 1, 7, 8. Adjustment is then effected in one of the two directions, for example in the vertical direction. For this purpose tang 27 is caused to rotate by means of a suitable tool so that projections 14 and 37 of second part 7 slide in grooves 10 and 17 of first part 1.

Horizontal adjustment is then effected when the vertical adjustment has been made.

For this purpose tang 29 is caused to rotate by means of a suitable tool so that longitudinal ribs 31 of third part 8 slide in lateral grooves 38 of triangular cross-section in second part 7. At the same time the lateral walls of central rib 32 of square cross-section of third part 8 contact the corresponding lateral walls of central groove 39 of second part 7, thus providing support for the third part and therefore door 42.

Bolts 9, 16 which were slackened off in order to make the adjustment are then tightened up.

It should be noted that the use of projections and grooves of triangular cross-section 38, 31 and 14, 10 provides perfect attachment between the parts after adjustment has been made, eliminating any play, while the engagement between square cross-section rib 32 and groove 39 offers a secure support for horizontal slip while adjustment is being made and the similar engagement 37, 17 provides correct guidance for vertical sliding.

I claim:

1. Apparatus for the adjustable attachment of a wardrobe door to a door supporting arm, the apparatus comprising:

a first member for attachment to the door supporting arm, the first member having a wall provided with at least two guide grooves, a first of the guide grooves of the first member wall having a substantially V-shaped cross section and a second of the guide grooves of the first member wall having a substantially square cross section;

a second member for connection to the wardrobe door, the second member having a wall, the wall of the second member having at least two projections provided thereon, including a first projection of substantially triangular cross section for mating with the V-shape cross section groove of the wall of the first member and a second projection of substantially square cross section for mating with the square cross section groove of the wall of the first member; and, first direction adjustment means for adjusting the position of the first member with respect to the second member along a first direction.

2. The apparatus of claim 1, wherein the grooves are longitudinally parallel to the first direction, wherein the projections are slidable in the first direction in the grooves in which they mate.

3. The apparatus of claim 1, wherein the first direction adjustment means comprises a rotatable threaded member for causing a sliding of the first member and second member relative to one another in the first direction.

4. The apparatus of claim 3, wherein the rotatable threaded member is engaged by the projection on the wall of the second member which has a substantially square cross section.

5. The apparatus of claim 1, wherein the first direction is a vertical direction.

6. The apparatus of claim 1, wherein the wall of the first member has two grooves of substantially V-shaped cross section, with the groove which has a substantially square cross section being located intermediate the two grooves of substantially V-shaped cross section grooves on the wall of the first member, and wherein the wall of the second member has two projections of substantially triangular cross section provided thereon, with the projection which has a substantially square cross section being located intermediate the two projections of substantially triangular cross section.

7. The apparatus of claim 1, wherein the second member is attached to a third member, with the third member in turn being for attachment to the wardrobe door, further comprising second direction adjustment means for adjusting the position of the second member with respect to the third member along a second direction, the second direction being perpendicular to the first direction.

8. The apparatus of claim 7, wherein the second direction is a horizontal direction.

9. The apparatus of claim 7, wherein the second member has a second wall provided with a pair of longitudinal grooves of substantially V-shaped cross section and an intermediate central groove of substantially square cross section.

10. The apparatus of claim 9, wherein the third member has a face bearing a pair of longitudinal ribs of substantially triangular cross section and a central rib of substantially square cross section, the ribs of the third member being adapted to mate with the grooves of the second member.

11. The apparatus of claim 7, wherein the second direction adjustment means comprises a rotatable threaded member which threadingly engages the second member and which is rotatably engaged by a fork provided on the third member.

12. The apparatus of claim 1, wherein the first member forms an internal space for housing the second and third members.

13. The apparatus of claim 1, wherein the wall of the first member has openings and the wall of the second member has openings alignable with the openings of the first member whereby bolts can pass through the openings and thereby secure the first and second members together.

* * * * *